US006352407B2

(12) United States Patent
Hill et al.

(10) Patent No.: US 6,352,407 B2
(45) **Date of Patent: *Mar. 5, 2002**

(54) BLADE ASSEMBLY FOR FAN APPARATUS

(75) Inventors: D. Lee Hill, Olean, NY (US); Frank E. Cahill, Lenexa, KS (US); Jimmy D. Vanfossan, deceased, late of Gladstone, MI (US), by Carolyn D. Vanfossan, legal representative; Hamid Massali, Leawood, KS (US)

(73) Assignee: Emerson Electric, Co., St. Louis, MO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/273,625

(22) Filed: Mar. 23, 1999

(51) Int. Cl.[7] ..... F01D 5/00

(52) U.S. Cl. ..... 416/144; 416/19; 416/145; 416/241 A; 74/573 R; 264/279; 425/190

(58) Field of Search ..... 416/19, 144, 145, 416/205, 207, 208, 214 R, 223 R, 229, 230, 241 A; 74/61, 87, 573 R; 264/219; 425/182, 185, 190, 192 R, 195; 29/888.025, 889.3

(56) References Cited

U.S. PATENT DOCUMENTS

| | | | | |
|---|---|---|---|---|
| 2,079,044 A | | 9/1932 | Santmyer | |
| 2,071,513 A | | 2/1937 | Everts | |
| 2,111,093 A | | 3/1938 | Droullard | |
| 2,129,939 A | | 9/1938 | Juul | |
| 2,173,291 A | | 9/1939 | Ash | |
| 2,498,283 A | * | 2/1950 | Lee | 416/19 |
| 2,636,720 A | | 4/1953 | Forrest | |
| 2,664,168 A | | 12/1953 | Giroz | |
| 3,074,487 A | | 1/1963 | Derschmidt | |
| 3,312,286 A | | 4/1967 | Irgens | |
| 3,323,597 A | * | 6/1967 | Longobardi et al. | 416/144 |
| 3,915,414 A | | 10/1975 | Shoulders | |
| 4,097,190 A | | 6/1978 | White | |
| 4,325,674 A | | 4/1982 | Ljungstrom | |
| 4,517,467 A | | 5/1985 | Fuhring | |
| 4,561,826 A | | 12/1985 | Taylor | |
| 4,692,094 A | | 9/1987 | Kulinyak | |
| 5,066,196 A | * | 11/1991 | Morofushi | 416/241 A |

* cited by examiner

*Primary Examiner*—Christopher Verdier
(74) *Attorney, Agent, or Firm*—Hovey, Williams, Timmons & Collins

(57) ABSTRACT

A single-blade fan apparatus includes a blade assembly having a hub presenting a longitudinal aperture adapted for receipt on the fan apparatus, a single blade protruding radially from the hub in a first direction, and a counterweight body protruding radially from the hub in a second direction opposite the first direction. The hub, blade and counterweight body are formed of a unitary piece of aluminum, zinc or synthetic resin material. A method of constructing the blade assembly includes providing a mold including a hub cavity, a blade cavity protruding from the hub cavity in a first direction, and a counterweight-body cavity protruding radially from the hub in a second direction opposite the first direction, and fitting a removable mold insert in the blade cavity. The first mold insert fills a portion of the blade cavity remote from the hub cavity. Aluminum, zinc or synthetic resin material is then cast or injected into the mold with the mold insert in place to form the blade assembly, resulting in the formation of a blade assembly including a blade having a dimension in the first direction that is shorter than the dimension of the blade in the first direction would be if the injection step was carried out with the mold insert removed from the blade cavity. A removable second mold insert is also provided and fills a portion of the counterweight-body cavity so that when material is cast or injected into the mold with the second insert in place, the blade assembly formed thereby includes a counterweight body having a mass that is smaller than the mass would be if the second mold insert were removed from the counterweight-body cavity.

38 Claims, 6 Drawing Sheets

Fig. 1.
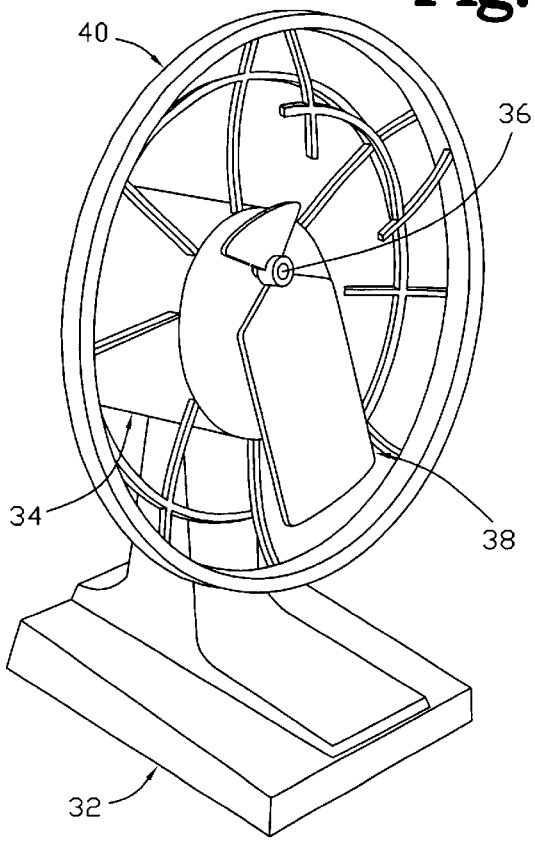
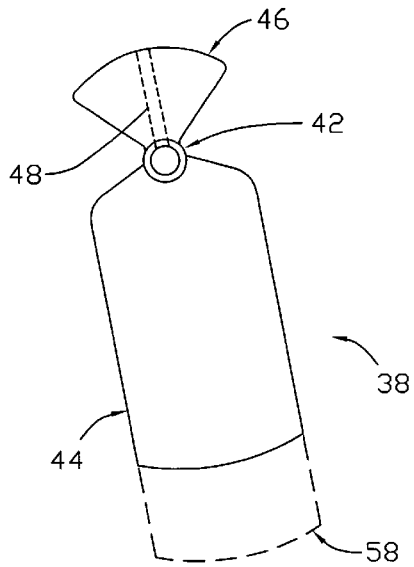
Fig. 2.
Fig. 3.
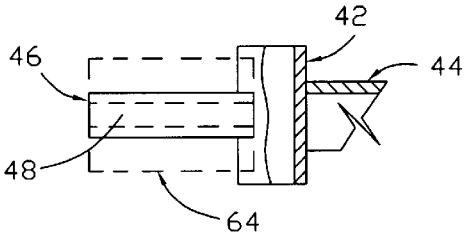
Fig. 4.
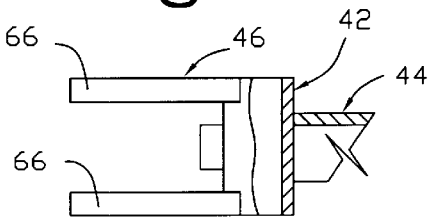
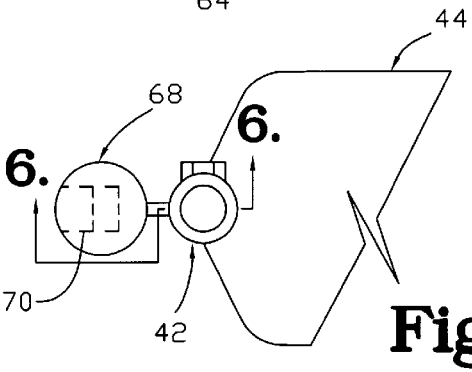
Fig. 5.
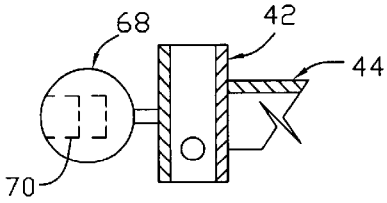
Fig. 6.

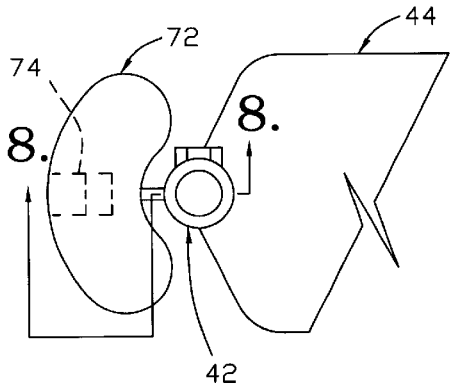
Fig. 7.
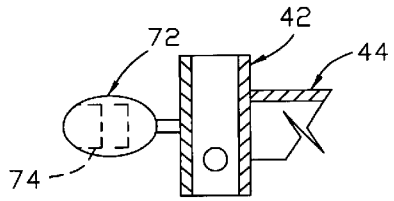
Fig. 8.
Fig. 9.
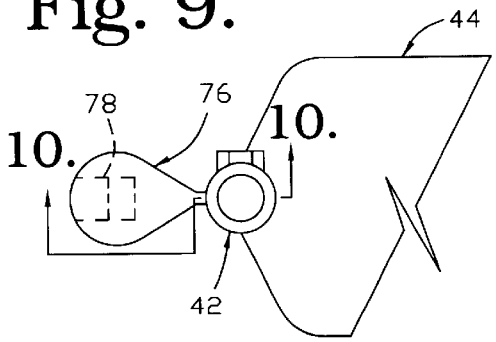
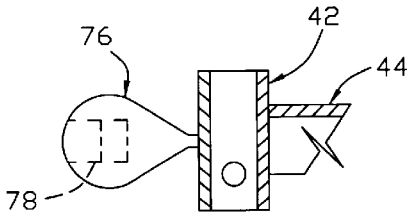
Fig. 10.
Fig. 11.
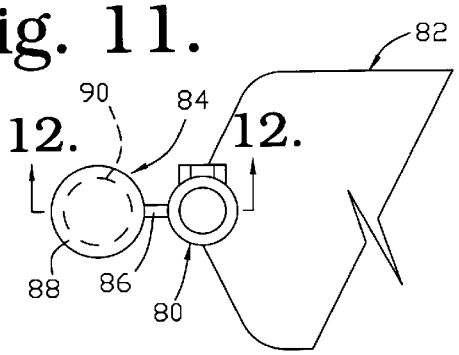
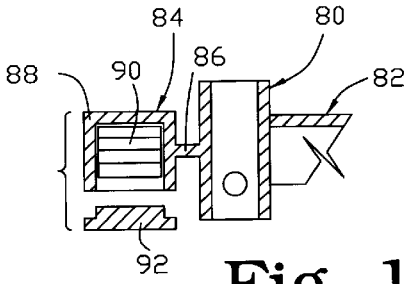
Fig. 12.
Fig. 13.
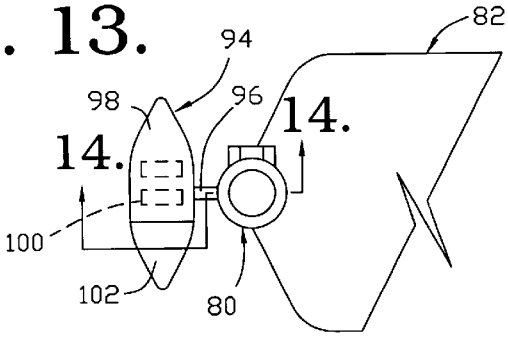

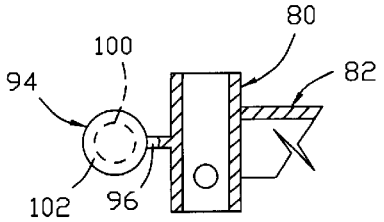
Fig. 14.
Fig. 15.
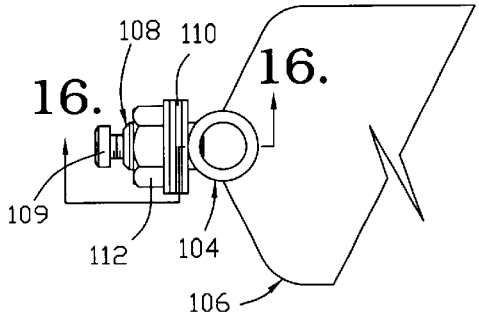
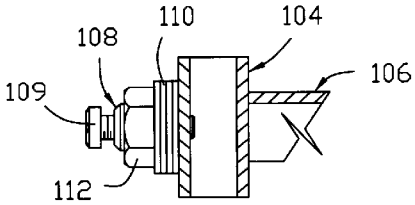
Fig. 16.
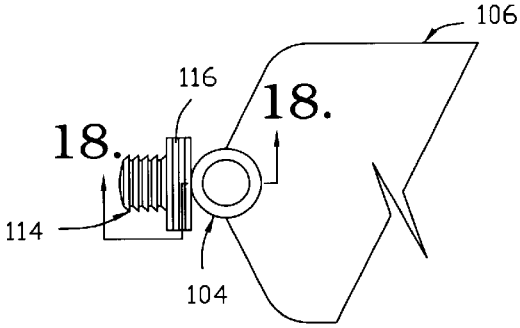
Fig. 17.
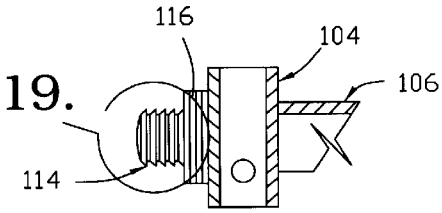
Fig. 18.
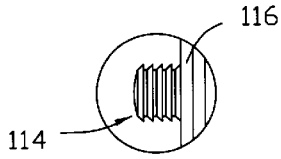
Fig. 19.
Fig. 20.
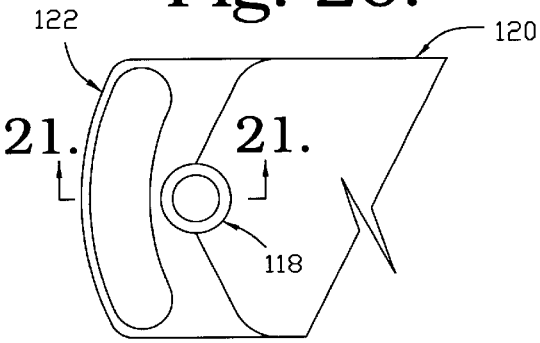
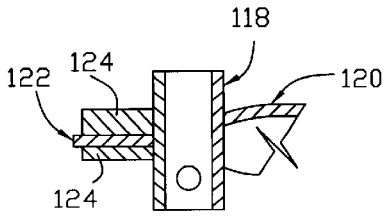
Fig. 21.

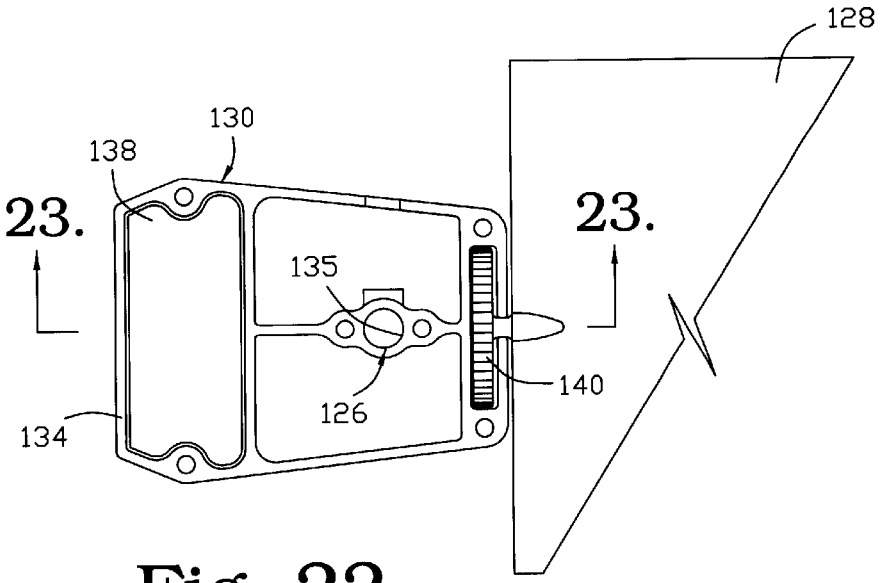
Fig. 22.
Fig. 23.
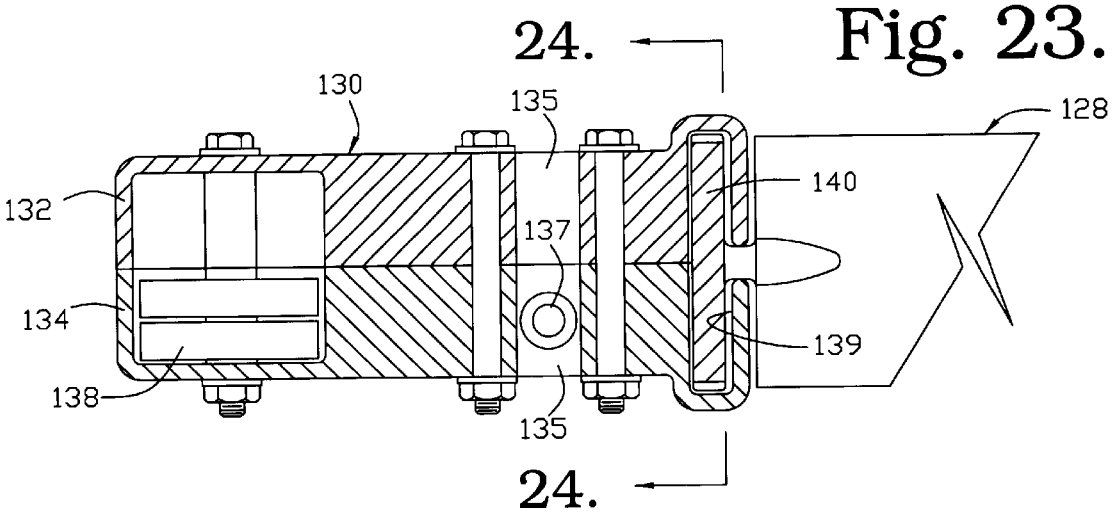
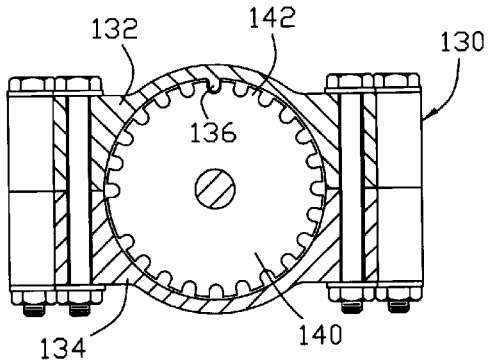
Fig. 24.

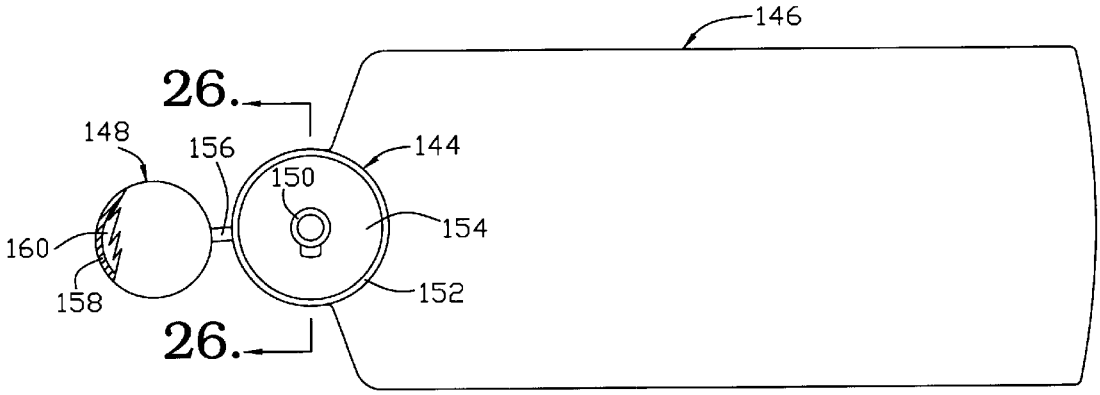
Fig. 25.
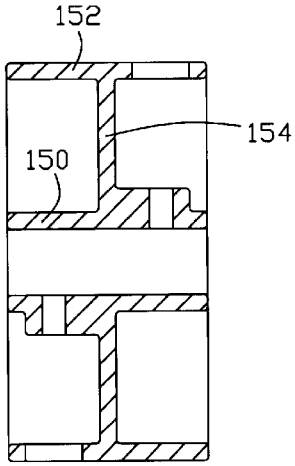
Fig. 26.
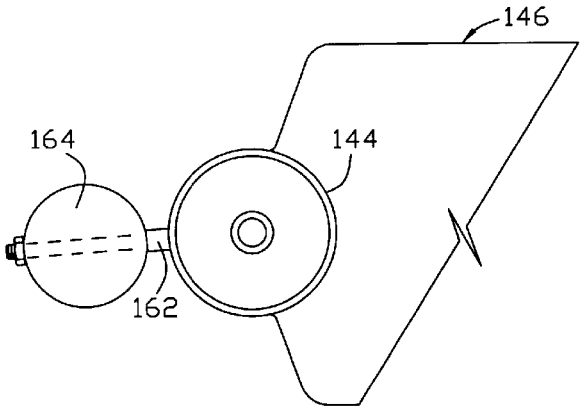
Fig. 27.
Fig. 28.
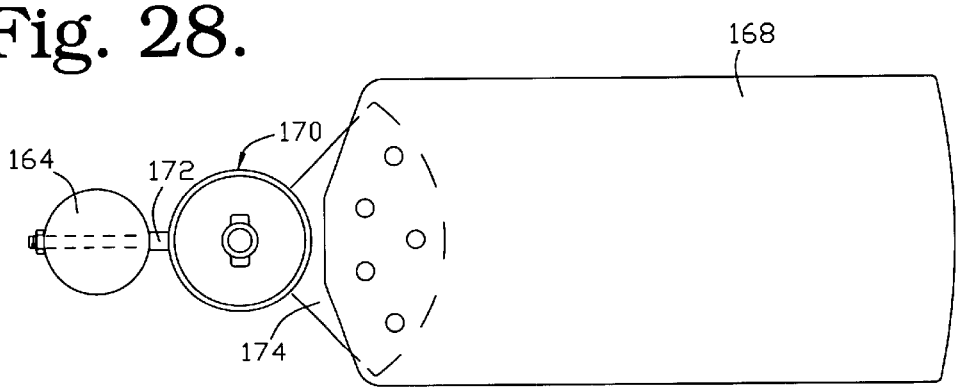

Fig. 29.
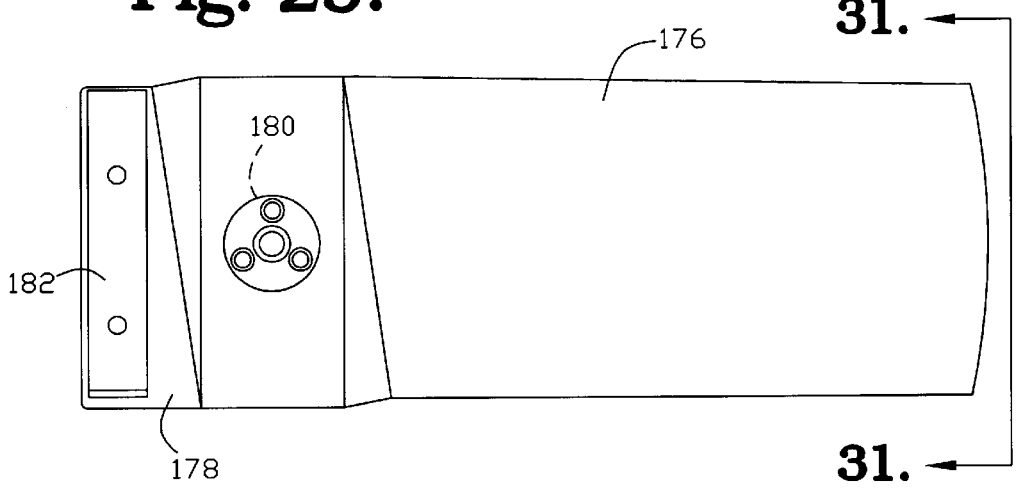
Fig. 30.
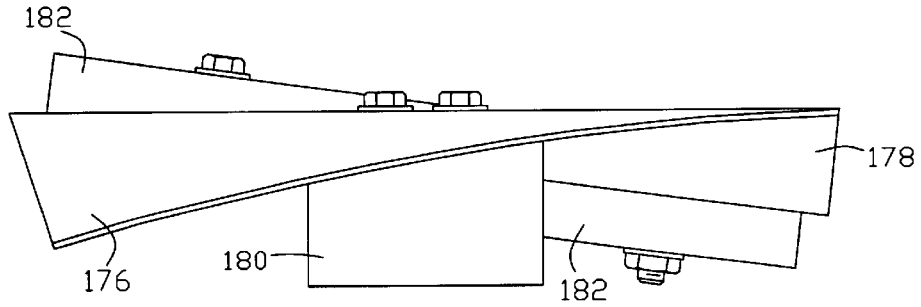
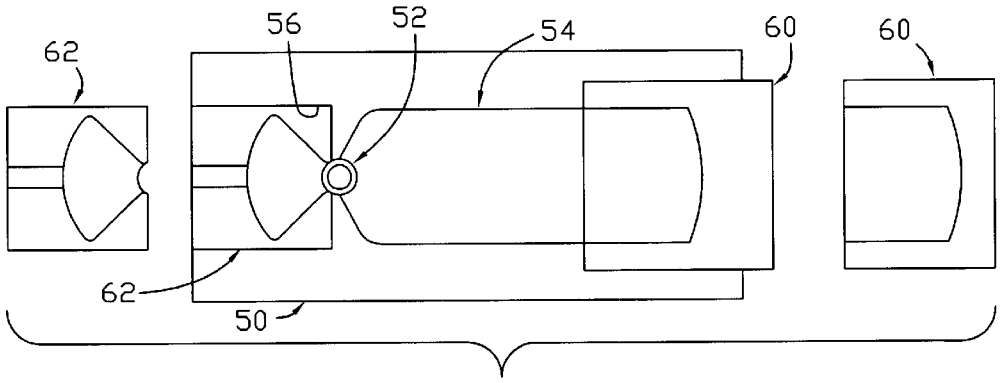
Fig. 31.

BLADE ASSEMBLY FOR FAN APPARATUS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates generally to motor-driven fans, and more particularly to a blade assembly for such fans, wherein the blade assembly includes a single blade balanced by a counterweight for rotation on a drive shaft of the fan.

It is known from U.S. Pat. No. 2,079,044, to Santmyer, to provide a fan having a blade assembly presenting a hub sized for receipt on a drive shaft of the fan, a single fan blade protruding radially from the hub in a first direction, and a counter weight protruding radially from the hub in a second direction opposite the first direction. This general type of blade assembly provides numerous advantages over other conventional blade assembly constructions incorporating two diametrically opposed, radially extending blades. For example, by employing only a single blade, the assembly creates less drag, increasing the efficiency of the fan. As such, it is possible for the fan to move more air with the single-blade assembly than if a multiple-blade assembly was used.

Although the conventional single-blade assembly provides such advantages over multiple-blade assemblies, some drawbacks exist. For example, the cost of manufacturing such single-blade assemblies out of metal is prohibitive, and if multiple sizes are to be manufactured, it is necessary to design each independently due to the configuration of the blade and counterweight employed.

BRIEF SUMMARY OF THE INVENTION

It is an object of the present invention to provide a blade assembly for a motor-driven fan, wherein the blade assembly is formed of a single piece of aluminum, zinc or synthetic resin material, and is of a configuration that permits different sizes of blades to be manufactured from a single mold.

Another object of the invention is to provide a blade assembly that provides a counter weight body having a mass that can be varied during or subsequent to manufacture to balance the blade assembly for rotation on a drive shaft of the fan.

A further object of the invention is to provide a method of manufacturing a blade assembly, wherein a single mold is used to produce blades and counter weights of different sizes and masses, reducing the cost of manufacture.

In accordance with these and other objects evident from the following description of a preferred embodiment of the invention, a method of constructing a blade assembly includes providing a mold presenting a hub cavity, a blade cavity protruding from the hub cavity in a first direction, and a counterweight-body cavity protruding radially from the hub in a second direction opposite the first direction, and fitting a removable first mold insert in the blade cavity, the first mold insert filling a portion of the blade cavity remote from the hub cavity. Thereafter, a synthetic resin material is injected into the mold with the first mold insert in place to form a blade assembly having a blade with a dimension in the first direction that is shorter than the dimension of the blade in the first direction would be if the synthetic resin material was injected into the mold with the first mold insert removed.

Preferably, the method also includes the step of fitting a removable second mold insert in the counterweight-body cavity, the second mold insert filling a portion of the counterweight-body cavity so that when synthetic resin material is injected into the mold, the blade assembly formed thereby includes a counterweight body having a mass that is smaller than the mass would be if the second mold insert were removed from the counterweight-body cavity.

By providing a method in accordance with the present invention, numerous advantages are realized. For example, by employing a mold and mold inserts in the manufacture of a blade assembly, it is possible to produce such assemblies of varying sizes with a single mold, substantially reducing the cost of manufacture. In addition, both the blade size and counter weight mass can be modified through the use of inserts, enabling the resulting assemblies to be properly balanced for operation on a fan apparatus.

The blade assembly of the present invention includes a hub presenting a longitudinal aperture adapted for receipt on the fan apparatus, a blade protruding radially from the hub in a first direction, and a counterweight body protruding radially from the hub in a second direction opposite the first direction, wherein the hub, blade and counterweight body are formed of a unitary piece of synthetic resin material. The counterweight body of the assembly can be a solid body or hollow, and provides all or a part of the counter weight necessary to balance the assembly for use. If additional weight is added, it is adhered or fastened to a support surface of the body. Alternately, a cavity can be formed in the body, within which additional weight is received.

By providing a blade assembly in accordance with the present invention, several advantages are obtained. For example, by forming the hub and counter weight body of the assembly as a single unitary part, the cost of the assembly is reduced relative to conventional constructions.

BRIEF DESCRIPTION OF THE SEVERAL VIEWS OF THE DRAWING

The preferred embodiment of the present invention is described in detail below with reference to the attached drawing figures, wherein:

FIG. 1 is perspective view of a fan apparatus incorporating a blade assembly constructed in accordance with the preferred embodiment;

FIG. 2 is a front elevational view of the blade assembly;

FIG. 3 is a fragmentary top plan view, partially in section, of the blade assembly;

FIG. 4 is a fragmentary top plan view, partially in section, of the blade assembly similar to FIG. 3, illustrating an alternate embodiment of a counter weight body forming a part thereof;

FIG. 5 is a fragmentary front elevational view of a blade assembly constructed in accordance with an alternate embodiment of the invention;

FIG. 6 is a fragmentary top plan view, partially in section, of the blade assembly shown in FIG. 5;

FIG. 7 is a fragmentary front elevational view of a blade assembly constructed in accordance with an alternate embodiment of the invention;

FIG. 8 is a fragmentary top plan view of the blade assembly shown in FIG. 7, partially sectioned to show various details thereof;

FIG. 9 is a fragmentary front elevational view of a blade assembly constructed in accordance with an alternate embodiment of the invention;

FIG. 10 is a fragmentary top plan view of the blade assembly shown in FIG. 9, partially sectioned to show various details thereof;

FIG. 11 is a fragmentary front elevational view of a blade assembly constructed in accordance with an alternate embodiment of the invention;

FIG. 12 is an exploded fragmentary top plan view of the blade assembly shown in FIG. 11, partially sectioned to show various details thereof;

FIG. 13 is a fragmentary front elevational view of a blade assembly constructed in accordance with an alternate embodiment of the invention;

FIG. 14 is an exploded fragmentary top plan view of the blade assembly shown in FIG. 13, partially sectioned to show various details thereof;

FIG. 15 is a fragmentary front elevational view of a blade assembly constructed in accordance with an alternate embodiment of the invention;

FIG. 16 is a fragmentary top plan view of the blade assembly shown in FIG. 15, partially sectioned to show various details thereof;

FIG. 17 is a fragmentary front elevational view of a blade assembly constructed in accordance with an alternate embodiment of the invention;

FIG. 18 is a fragmentary top plan view of the blade assembly shown in FIG. 17, partially sectioned to show various details thereof;

FIG. 19 is an enlarged fragmentary view of the area inside line 19 of FIG. 18;

FIG. 20 is a fragmentary front elevational view of a blade assembly constructed in accordance with an alternate embodiment of the invention;

FIG. 21 is a fragmentary top plan view of the blade assembly shown in FIG. 20;

FIG. 22 is a fragmentary front elevational view of a blade assembly constructed in accordance with an alternate embodiment of the invention, with a portion of the hub section thereof removed to show various details thereof;

FIG. 23 is a fragmentary top plan view of the blade assembly shown in FIG. 22, partially sectioned to show various details thereof;

FIG. 24 is a sectional view taken along line 24—24 of FIG. 23;

FIG. 25 is a fragmentary front elevational view of a blade assembly constructed in accordance with an alternate embodiment of the invention, partially cut away to show various details thereof;

FIG. 26 is a sectional view taken along line 26—26 of FIG. 25;

FIG. 27 is a fragmentary front elevational view of a blade assembly constructed in accordance with an alternate embodiment of the invention;

FIG. 28 is a fragmentary front elevational view of a blade assembly constructed in accordance with an alternate embodiment of the invention;

FIG. 29 is a front elevational view of a blade assembly constructed in accordance with an alternate embodiment of the invention;

FIG. 30 is an end elevational view of the blade assembly shown in FIG. 29; and FIG. 31 is a schematic view of a mold for forming the blade assembly shown in FIGS. 1–3.

DETAILED DESCRIPTION OF THE INVENTION

A motor-driven fan apparatus is illustrated in FIG. 1, and broadly includes a base 32, a motor 34 supported on the base and presenting a rotary drive shaft 36, and a blade assembly 38 secured to the drive shaft for rotation therewith. Preferably, a cage or grill 40 is supported on the apparatus and encloses the blade assembly to prevent human contact with the assembly during operation.

The blade assembly of the present invention is described with reference to the various embodiments shown in the drawing figures, each of the embodiments providing certain unique advantages relative both to conventional constructions and to the other disclosed embodiments.

Turning first to the embodiment illustrated in FIGS. 1–3, and with reference to FIG. 2, the blade assembly 38 of the present invention broadly includes a hub 42, a blade 44, and a counterweight body 46. The entire assembly is molded as a unitary piece of synthetic resin material such as high density polyethylene, polypropylene, or any other suitable composition that lends itself to injection or rotation molding techniques.

As shown in FIG. 3, the hub 42 is tubular, presenting a central longitudinal axis and an inner diameter that permits the hub to be received on the drive shaft of the fan apparatus. A threaded transverse hole 48 is tapped or otherwise formed in the hub so that a set screw or the like can be used to fasten the blade assembly on the drive shaft of the apparatus for rotation therewith.

Returning to FIG. 2, the blade 44 protrudes radially from the hub 42 in a first direction, and includes a proximal end that is integral with the hub, and a distal end remote therefrom. The blade 44 also presents leading and trailing edges that are separated from one another by the width of the blade, and the width is substantially constant along the length of the blade such that the blade presents a generally rectangular shape in front elevation. Preferably, the thickness of the blade varies between the leading and trailing edges, wherein the blade is thickest at or near the leading edge, and is thinnest at the trailing edge. However, the width and thickness of the blade may take any desired form, and other blade plan forms and/or profiles can be employed without departing from the present invention.

The counterweight body 46 protrudes radially from the hub 42 in a second direction opposite the first direction, and includes a proximal end that is integral with the hub, and a distal end remote therefrom. The counter weight body 46 includes a width that varies along the length thereof between a narrow width at the proximal end of the body to a broad width at the distal end. As such, the body presents a generally triangular shape in front elevation. Preferably, the thickness of the counterweight body is constant along the width of the body, and this thickness can be varied from assembly to assembly during manufacture to provide assemblies of a wide variety of masses. The hole 48 extends through the counter weight body in a radial direction relative to the hub, and permits the set screw to be threaded into the hole against the drive shaft of the fan. Alternately, the transverse hole 48 in the hub could be formed at a position displaced 90° from that shown in FIG. 2, such that it is accessible from a position outside the counter weight body.

The mass of the counterweight body 46 is selected to balance the assembly so that no centrifugal forces are exerted on the drive shaft during rotation of the assembly. In order to obtain such balance, it is necessary that the product of the mass of the counterweight body ($m_{body}$) and the distance ($d_{body}$) between the center of mass of the body and the longitudinal axis of the hub is equal to the product of the mass of the blade ($m_{blade}$) and the distance ($d_{blade}$) between the center of mass of the blade and the longitudinal axis of the hub. In other words: $(m_{body})(d_{body})=(m_{blade})(d_{blade})$.

The method of manufacturing the blade assembly 38 includes molding the assembly as a unitary part using a synthetic resin material. As shown in FIG. 31, the mold 50 is preferably adapted for use in an injection molding machine. However, it could also be one adapted for use in a rotation molding machine, or in any other known type of molding machine capable of use in forming synthetic resins such as high density polyethylene or polypropylene.

The mold 50 includes a hub cavity 52, a blade cavity 54 protruding from the hub cavity in a first direction, and a counterweight-body cavity 56 protruding radially from the hub in a second direction opposite the first direction. The cavities 52, 54, 56 are in communication with one another so that the blade assembly can be formed of a unitary molded piece of synthetic resin material. One or more removable first mold inserts 60 are provided, and each is sized for receipt in the blade cavity 54 to adjust the size of the blade cavity. Preferably, the first mold 60 inserts fill a portion of the blade cavity 52 remote from the hub cavity such that when a blade assembly is molded with an insert in place, the length of the molded blade is larger or smaller than that of a blade molded with another of the inserts in place. The shorter blade is depicted in a solid line in FIG. 2, and the longer blade is depicted in a broken line 58.

Although the use of mold inserts 60 for the blade cavity 54 permits adjustment in the length of the blade of the assembly formed by the mold, it is necessary to also adjust the mass of the counter weight body to balance the assembly for use on the fan apparatus. Thus, one or more removable second mold inserts 62 are provided which can be fitted in the counterweight-body cavity 56. Each second mold insert 62 fills a portion of the counterweight-body cavity so that when synthetic resin material is injected into the mold, the blade assembly formed thereby includes a counterweight body having a mass that is larger or smaller than the mass would be if another of the second mold inserts was in place. The smaller mass of the counter weight body is depicted in a solid line in FIG. 3, and the larger mass is depicted in a broken line 64.

By using the first and second inserts 60, 62 in combination with one another, the size of the blade 44 and mass of the body 46 can be adjusted to permit the manufacture of at least two different blade assembly sizes using a single mold. In addition, the substitute inserts 60, 62 can be employed to add to the number of different sizes of blade assemblies capable of being produced from the single mold. Thus, the cost of producing blade assemblies of various sizes is reduced relative to conventional construction in which separate molds are required for each size of the assembly.

As shown in FIG. 1, the blade assembly 38 is assembled on the fan apparatus by sliding the hub onto the drive shaft 36 and securing it in place with the set screw so that the blade assembly rotates with the shaft when powered by the motor 34. The single blade 44 presented on the assembly creates less drag than a conventional assembly having multiple blades, and thus moves air more efficiently than conventional constructions.

An alternate construction of the blade assembly is illustrated in FIG. 4, wherein the counter weight body is illustrated as including a pair of body elements 66 that are spaced longitudinally from one another relative to the hub. In order to manufacture a blade assembly in accordance with this embodiment, the same steps are followed as described above with reference to the assembly shown in FIGS. 2 and 3. However, in place of the second mold insert described previously, a different second mold insert is provided for the counter-weight cavity. The alternate mold insert fills a portion of the cavity such that both elements 66 are formed during the molding process.

Various alternate constructions of the blade assembly are shown in FIGS. 5–10. As illustrated in FIGS. 5 and 6, the assembly is substantially identical to the assembly described above with reference to FIGS. 2 and 3, except that the counter weight body 68 in the embodiment of FIGS. 5 and 6 includes a proximal end that is cylindrical, rod-shaped, or of some other aerodynamic shape, and the distal end of the body is spherical.

In order to manufacture a blade assembly in accordance with the embodiment of FIGS. 5 and 6, the same steps are followed as described above with reference to the assembly shown in FIGS. 2 and 3. However, the mold used to manufacture the assembly of FIGS. 5 and 6 includes a counter weight body cavity having a spherical shape, and the second mold insert fills a portion of the cavity extending from the distal end of the cavity radially inward toward the hub. As such, when the mold insert is in place, the blade assembly molded therein includes a spherical shape that includes a hollow recess, shown in a broken line 70 in FIGS. 5 and 6, and when the insert is removed, a solid spherical mass is formed. As with the embodiments described previously, a plurality of different inserts can be provided for the counter weight body cavity, wherein each insert fills a different volume of the cavity such that the mass of the body molded in the cavity can be controlled to balance the blade assembly.

Turning to FIGS. 7 and 8, an assembly is illustrated which is substantially identical to the assembly described above with reference to FIGS. 2 and 3, except that the counter weight body 72 in the embodiment of FIGS. 7 and 8 includes a proximal end that is cylindrical, rod-shaped, or of some other aerodynamic shape, and the distal end of the body is shaped like a kidney bean.

In order to manufacture a blade assembly in accordance with the embodiment of FIGS. 7 and 8, the same steps are followed as described above with reference to the assembly shown in FIGS. 2 and 3. However, the mold used to manufacture the assembly of FIGS. 7 and 8 includes a counter weight body cavity having a kidney bean shape, and the second mold insert fills a portion of the cavity extending from the distal end of the cavity radially inward toward the hub. As such, when the mold insert is in place, the blade assembly molded therein includes a kidney bean shape that includes a hollow recess, shown in a broken line 74 in FIGS. 7 and 8, and when the insert is removed, a solid kidney bean shaped mass is formed. As with the embodiments described previously, a plurality of different inserts can be provided for the counter weight body cavity, wherein each insert fills a different volume of the cavity such that the mass of the body molded in the cavity can be controlled to balance the blade assembly.

As illustrated in FIGS. 9 and 10, an alternate embodiment of the assembly is substantially identical to the assembly described above with reference to FIGS. 2 and 3, except that the counter weight body 76 in the embodiment of FIGS. 9 and 10 is shaped like a tear drop, presenting a tapered proximal end connected to the hub and a bulbous distal end.

In order to manufacture a blade assembly in accordance with the embodiment FIGS. 9 and 10, the same steps are followed as described above with reference to the assembly shown in FIGS. 2 and 3. However, the mold used to manufacture the assembly of FIGS. 9 and 10 includes a counter weight body cavity having a tear drop shape, and the second mold insert fills a portion of the cavity extending from the distal end of the cavity radially inward toward the hub. As such, when the mold insert is in place, the blade assembly molded therein includes a tear drop shape that includes a hollow recess extending inward from the distal end thereof, shown in a broken line 78 in FIGS. 9 and 10, and when the inset is removed, a solid tear drop shaped mass is formed. As with the embodiments described previously, a plurality of different inserts can be provided for the counter weight body cavity, wherein each insert fills a different volume of the cavity such that the mass of the body molded in the cavity can be controlled to balance the blade assembly.

An alternate construction of the blade assembly of the present invention is illustrated in FIGS. 11 and 12, and includes a hub 80, a blade 82, and a counterweight body 84. As with the previously described embodiments, the entire assembly is molded as a unitary piece of synthetic resin material such as high density polyethylene, polypropylene, or any other suitable composition that lends itself to injection or rotation molding techniques.

As shown in FIG. 12, the hub 80 of the assembly is tubular, presenting a central longitudinal axis and an inner diameter that permits the hub to be received on the drive shaft of the fan apparatus. A threaded transverse hole is tapped or otherwise formed in the hub so that a set screw or the like can be used to fasten the blade assembly on the drive shaft of the apparatus for rotation therewith.

As illustrated in FIG. 11, the blade 82 protrudes radially from the hub in a first direction, and includes a proximal end that is integral with the hub, and a distal end remote therefrom. The blade also presents leading and trailing edges that are separated from one another by the width of the blade, and the width is substantially constant along the length of the blade such that the blade presents a generally rectangular shape in front elevation. Preferably, the thickness of the blade varies between the leading and trailing edges, wherein the blade is thickest at or near the leading edge, and is thinnest at the trailing edge. However, the width and thickness of the blade may take any desired form, and other blade plan forms and/or profiles can be employed without departing from the present invention.

The counterweight body 84 protrudes radially from the hub 80 in a second direction opposite the first direction, and includes a shaft or neck 86 at the proximal end that is integral with the hub, and a receptacle 88 at the distal end. As shown in FIG. 12, the receptacle 88 includes an interior cavity sized for receipt of one or more weights 90 that are retained in the receptacle either by a cap 92 or by an adhesive backing that can be provided on the weights. As such, the weight of the counter weight body can be supplemented to balance the assembly for rotation on the drive shaft of the fan apparatus.

The combined mass of the counterweight body 84, the cap 92, and the weights 90 is selected to balance the assembly so that no centrifugal forces are exerted on the drive shaft during rotation of the assembly. In order to obtain such balance, it is necessary that the product of the combined mass of the counterweight body, cap and weight ($m_{body+weight+cap}$) and the distance ($d_{body+weight+cap}$) between the center of the combined mass and the longitudinal axis of the hub is equal to the product of the mass of the blade ($m_{blade}$) and the distance ($d_{blade}$) between the center of mass of the blade and the longitudinal axis of the hub. In other words: $(m_{body+weight+cap})(d_{body+weight+cap})=(m_{blade})(d_{blade})$.

The method of manufacturing the blade assembly shown in FIGS. 11 and 12, includes molding the assembly as a unitary part using a synthetic resin material. The mold is preferably adapted for use in an injection molding machine. However, it could also be one adapted for use in a rotation molding machine, or in any other known type of molding machine capable of use in forming synthetic resins such as high density polyethylene or polypropylene.

The mold includes a hub cavity, a blade cavity protruding from the hub cavity in a first direction, and a counterweight-body cavity protruding radially from the hub in a second direction opposite the first direction. The cavities are in communication with one another so that the blade assembly can be formed of a unitary molded piece of synthetic resin material. One or more removable first mold inserts are provided, and each is sized for receipt in the blade cavity to adjust the size of the blade cavity. Preferably, the first mold inserts fill a portion of the blade cavity remote from the hub cavity such that when a blade assembly is molded with another of the inserts in place, the length of the molded blade is larger or smaller than that of a blade molded with another of the inserts in place.

Although the use of a mold insert for the blade cavity permits adjustment in the length of the blade of the assembly formed by the mold, it is necessary to also adjust the mass of the counter weight body to balance the assembly for use on the fan apparatus. However, because the counterweight body presents a receptacle within which additional weight can be placed, it is not necessary to employ a second mold insert as with the previously described embodiments. Instead, the mass of the body is designed to be less than or equal to that required to balance the assembly when the first mold insert is used, and additional weight is added to the receptacle, if necessary, to balance the assembly.

A variation of the embodiment of FIGS. 11 and 12 is illustrated in FIGS. 13 and 14, wherein the blade assemblies are identical except for the shape of the counter weightbodies. As shown in FIG. 13, the counterweight body 94 protrudes radially from the hub in a second direction opposite the first direction, and includes a shaft or neck 96 at the proximal end that is integral with the hub, and a receptacle 98 at the distal end. The receptacle 98 includes an interior cavity sized for receipt of one or more weights 100 that are retained in the receptacle by a cap 102 that is secured to the body by either an adhesive or a threaded connection. As such, the weight of the counter weight body can be supplemented to balance the assembly for rotation on the drive shaft of the fan apparatus.

The sole difference between the embodiment of FIGS. 11 and 12 and that of FIGS. 13 and 14 resides in the shape of the receptacle 98 and cap 102. In the assembly shown in FIGS. 11 and 12, the receptacle 88 is preferably cylindrical, defining a longitudinal axis that is parallel to the longitudinal axis of the hub 80 and perpendicular to the length of the blade 82. However, the receptacle 98, shown in FIGS. 13 and 14, includes a tapered elliptical shape that defines a longitudinal axis that is perpendicular to both the longitudinal axis of the hub 80 and the length of the blade 82. As such, the body receptacle 98 and cap 102 present a streamlined profile that reduces the drag created by the blade assembly during rotation.

Turning to FIGS. 15 and 16, an alternate embodiment of the blade assembly of the present invention is illustrated. As shown in FIG. 15, the assembly includes a hub 104, a blade 106, and a counterweight body 108. As with the previously described embodiments, the entire assembly is molded as a unitary piece of synthetic resin material such as high density polyethylene, polypropylene, or any other suitable composition that lends itself to injection or rotation molding techniques.

The hub 104 of the assembly is tubular, presenting a central longitudinal axis and an inner diameter that permits the hub to be received on the drive shaft of the fan apparatus. A threaded transverse hole is tapped or otherwise formed in the hub and extends radially through the counter weight body so that a set screw or the like can be used to fasten the blade assembly on the drive shaft of the apparatus for rotation therewith.

The blade 106 protrudes radially from the hub in a first direction, and includes a proximal end that is integral with the hub, and a distal end remote therefrom. The blade also presents leading and trailing edges that are separated from one another by the width of the blade, and the width is substantially constant along the length of the blade such that the blade presents a generally rectangular shape in front elevation. Preferably, the thickness of the blade varies between the leading and trailing edges, wherein the blade is thickest at or near the leading edge, and is thinnest at the trailing edge. However, the width and thickness of the blade may take any desired form, and other blade plan forms, and/or profiles can be employed without departing from the present invention.

The counterweight body 108 protrudes radially from the hub 104 in a second direction opposite the first direction, and includes a tubular molded stud or shaft presenting a proximal end that is integral with the hub, and a remote distal end. The transverse hole in the hub 104 is aligned with the hollow central bore of the counterweight body 108, and a set screw 109 can be threaded into the bore to secure the assembly to the drive shaft of the fan. The outer surface of the stud is threaded along the distal end of the body, and defines a support surface sized for receipt of one or more annular weights 110 that are retained on the stud by a threaded nut 112. As such, the weight of the counterweight body can be supplemented to balance the assembly for rotation on the drive shaft of the fan apparatus.

The method of manufacturing the blade assembly shown in FIGS. 15 and 16, includes molding the assembly as a unitary part using a synthetic resin material such as high density polyethylene or polypropylene. The mold is preferably adapted for use in an injection or rotation molding machine, or any other type of machine capable of use in forming such materials.

The mold includes a hub cavity, a blade cavity protruding from the hub cavity in a first direction, and a counterweight-body cavity protruding radially from the hub in a second direction opposite the first direction. The cavities are in communication with one another so that the blade assembly can be formed of a unitary molded piece of synthetic resin material. A removable first mold insert is provided, and is sized for receipt in the blade cavity to reduce the size of the blade cavity. Preferably, the first mold insert fills a portion of the blade cavity remote from the hub cavity such that when a blade assembly is molded with the insert in place, the length of the molded blade is smaller than that of a blade molded with the insert removed from the blade cavity.

Although the use of a mold insert for the blade cavity permits adjustment in the length of the blade of the assembly formed by the mold, it is necessary to also adjust the mass of the counter weight body to balance the assembly for use on the fan apparatus. However, because the counterweight body presents a stud on which additional weight can be placed, it is not necessary to employ a second mold insert as with the previously described embodiments. Instead, the mass of the body is designed to be less than or equal to that required to balance the assembly when the first mold insert is used, and additional weight is added to the body, if necessary, to balance the assembly.

A variation of the assembly is illustrated in FIGS. 17–19, wherein the blade assemblies are identical except for the configuration of the counter weight bodies. As shown in FIG. 19, the counterweight body 114 includes an outer support surface that is grooved rather than threaded, and the grooves are separated from one another by ridges or detents. As such, the surface provides a built-in means for retaining weights 116 on the body, and it is not necessary to employ a nut for such purpose. The weights 116 used with the embodiment of FIGS. 17–19 present an inner diameter that is smaller than the diameter of the ridges so that the weights are fixed on the stud 114.

A further embodiment of the blade assembly of the present invention is illustrated in FIGS. 20 and 21, and includes a hub 118, a blade 120, and a counterweight body 122. As with the previously described embodiments, the entire assembly is molded as a unitary piece of synthetic resin material such as high density polyethylene, polypropylene, or any other suitable composition that lends itself to injection or rotation molding techniques.

As shown in FIG. 21, the hub 118 of the assembly is tubular, presenting a central longitudinal axis and an inner diameter that permits the hub to be received on the drive shaft of the fan apparatus. A threaded transverse hole is tapped or otherwise formed in the hub so that a set screw or the like can be used to fasten the blade assembly on the drive shaft of the apparatus for rotation therewith.

The blade 120 protrudes radially from the hub 118 in a first direction, and includes a proximal end that is integral with the hub, and a distal end remote therefrom. The blade also presents leading and trailing edges that are separated from one another by the width of the blade. Preferably, the thickness of the blade varies between the leading and trailing edges, wherein the blade is thickest at or near the leading edge, and is thinnest at the trailing edge. However, other blade plan forms and/or profiles can be employed without departing from the present invention.

The counterweight body 122 protrudes from the proximal end of the blade in a second direction opposite the first direction, and includes a generally planar shape defining a pair of opposed support surfaces sized for receipt of one or more weights 124 that are retained on the surface by threaded fasteners or by an adhesive. As such, the weight of the counter weight body can be supplemented to balance the assembly for rotation on the drive shaft of the fan apparatus.

The method of manufacturing the blade assembly shown in FIGS. 20 and 21, includes molding the assembly as a unitary part using a synthetic resin material, as described. The mold is preferably adapted for use in an injection or rotation molding machine, or any other type of machine capable of use in forming such materials.

The mold includes a hub cavity, a blade cavity protruding from the hub cavity in a first direction, and a counterweight-body cavity protruding radially from the hub in a second direction opposite the first direction. The cavities are in communication with one another so that the blade assembly can be formed of a unitary molded piece of synthetic resin material. A removable first mold insert is provided, and is sized for receipt in the blade cavity to reduce the size of the blade cavity. Preferably, the first mold insert fills a portion of the blade cavity remote from the hub cavity such that when a blade assembly is molded with the insert in place, the length of the molded blade is smaller than that of a blade molded with the insert removed from the blade cavity.

Although the use of a mold insert for the blade cavity permits adjustment in the length of the blade of the assembly formed by the mold, it is necessary to also adjust the mass of the counter weight body to balance the assembly for use on the fan apparatus. However, because the counterweight body 122 presents at least one support surface on which additional weight can be placed, it is not necessary to employ a second mold insert as with the previously described embodiments. Instead, the mass of the body is designed to be less than or equal to that required to balance the assembly when the first mold insert is used, and additional weight is added to the body, if necessary, to balance the assembly.

Another embodiment of the present invention is shown in FIGS. 22–24, and broadly includes a hub 126, a blade 128, and a counterweight body 130, all molded of synthetic resin material such as high density polyethylene, polypropylene, or any other suitable composition that lends itself to injection or rotation molding techniques. However, unlike the previously described embodiments, only the hub and counter weight body are unitary, and the blade 128 is molded separately such that the pitch of the blade can be adjusted relative to the hub.

As shown in FIG. 23, the hub and counter weight body of the assembly are formed by two symmetrical hub elements 132, 134 that are individually molded and secured together by threaded fasteners during assembly. Each element includes a bore 135 presenting a central longitudinal axis and an inner diameter that permits the hub to be received on the drive shaft of the fan apparatus. A threaded transverse hole 137 is tapped or otherwise formed in the hub element 134 so that a set screw or the like can be used to fasten the blade assembly on the drive shaft of the apparatus for rotation therewith.

A hollow, cylindrical blade support cavity 139 is formed in the hub elements, and a hole protrudes radially from the hub in a first direction from the cavity such that the blade can be secured to the hub. As shown in FIG. 24, the inner circumferential wall of the cavity includes at least one detent 136 that protrudes into the cavity for engaging the blade, as described below, and for holding the blade against relative rotation about the axis of the cavity.

As illustrated in FIG. 23, the counterweight body 130 defined by the elements 132, 134 protrudes from the bore of the hub in a second direction opposite the first direction, and includes a hollow interior cavity in which one or more weights 138 can be received during assembly. As such, the weight of the counter weight body can be supplemented to balance the assembly for rotation on the drive shaft of the fan apparatus.

As shown in FIG. 22, the blade 128 protrudes radially from the hub in the first direction, and includes a circular flange 140 at the proximal end thereof, and a distal end remote therefrom. The circular flange 140 defines a central axis that is collinear with the longitudinal axis of the blade, and presents an outer circumferential surface provided with a plurality of teeth or detents 142. As shown in FIG. 23, the blade also presents leading and trailing edges that are separated from one another by the width of the blade. Preferably, the thickness of the blade varies between the leading and trailing edges, wherein the blade is thickest at or near the leading edge, and is thinnest at the trailing edge. However, other blade plan forms and/or profiles can be employed without departing from the present invention.

The method of manufacturing the blade assembly shown in FIGS. 22–24, includes molding elements 132, 134 and the blade 128 as separate parts, using a synthetic resin material, as described. The molds are preferably adapted for use in an injection or rotation molding machine, or any other type of machine capable of use in forming such materials.

The mold for the blade 128 includes a blade cavity, and a removable first mold insert is provided that is sized for receipt in the blade cavity to reduce its size. Preferably, the first mold insert fills the distal portion of the blade cavity remote from the circular flange cavity such that when a blade assembly is molded with the insert in place, the length of the molded blade is smaller than that of a blade molded with the insert removed from the blade cavity. No inserts are provided for the mold in which the hub elements 132, 134 are formed. However, because the counterweight body 130 presents a cavity within which additional weight can be placed, it is not necessary to employ such an insert. Instead, the combined mass of the elements 132, 134 is designed to be less than or equal to that required to balance the assembly when the first mold insert is used, and additional weight is added to the body 130, if necessary, to balance the assembly.

Once the parts 128, 132, 134 of the assembly are molded, the flange 140 of the blade 128 is enclosed within the support cavity of the hub 126, with the pitch of the blade set at any desired angle. The teeth 142 on the flange are subsequently engaged by the detents 136 of the hub to retain the pitch of the blade fixed. As such, if the pitch is to be adjusted, it is necessary to separate the elements 132, 134, and make the adjustment. In addition to fixing the blade on the hub, any weights to be added to the counter weight body are placed in the cavity before the hub elements are fastened together. After the hub elements are secured together, the pitch of the blade is fixed and the weights are secured inside the cavity.

An alternate embodiment of the present invention is illustrated in FIGS. 25 and 26, and includes a hub 144, a blade 146, and a counterweight body 148. The entire assembly is molded as a unitary piece of synthetic resin material such as high density polyethylene, polypropylene, or any other suitable composition that lends itself to injection or rotation molding techniques.

As shown in FIG. 26, the hub 144 of the assembly is tubular, including an inner wall 150 defining a longitudinal bore and a central longitudinal axis, and an outer wall 152 spaced radially from the inner wall and connected thereto by an annular web 154 of synthetic resin material. However, other aerodynamic outer wall forms may be employed without departing from the present invention. The bore defined by the inner wall 150 includes an inner diameter that permits the hub to be received on the drive shaft of the fan apparatus. At least one threaded transverse hole is tapped or otherwise formed in the inner wall so that one or more set screws or the like can be used to fasten the blade assembly on the drive shaft of the apparatus for rotation therewith.

Returning to FIG. 25, the blade 146 protrudes radially from the hub in a first direction, and includes a proximal end that is integral with the outer wall of the hub, and a distal end remote therefrom. The blade also presents leading and trailing edges that are separated from one another by the width of the blade. Preferably, the thickness of the blade varies between the leading and trailing edges, wherein the blade is thickest at or near the leading edge, and is thinnest at the trailing edge. However, other blade plan forms and/or profiles can be employed without departing from the present invention.

The counterweight body 148 protrudes radially from the hub in a second direction opposite the first direction, and includes a shaft or neck 156 at the proximal end that is integral with the outer wall of the hub, and a receptacle or shell 158 at the distal end. The receptacle 158 includes an interior cavity sized for receipt of a weight 160 that is molded into the body so as to be completely encapsulated thereby. As such, the weight of the counter weight body is supplemented to balance the assembly for rotation on the drive shaft of the fan apparatus.

The method of manufacturing the blade assembly shown in FIGS. 25 and 26, includes molding the assembly as a unitary part using a synthetic resin material. The mold is preferably adapted for use in an injection molding machine. However, it could also be one adapted for use in a rotation molding machine, or in any other known type of molding machine capable of use in forming synthetic resins such as high density polyethylene or polypropylene.

The mold includes a hub cavity, a blade cavity protruding from the hub cavity in a first direction, and a counterweight-body cavity protruding radially from the hub in a second direction opposite the first direction. The cavities are in communication with one another so that the blade assembly can be formed of a unitary molded piece of synthetic resin material. A removable first mold insert is provided, and is sized for receipt in the blade cavity to reduce the size of the blade cavity. Preferably, the first mold insert fills a portion of the blade cavity remote from the hub cavity such that when a blade assembly is molded with the insert in place, the length of the molded blade is smaller than that of a blade molded with the insert removed from the blade cavity.

Although the use of a mold insert for the blade cavity permits adjustment in the length of the blade of the assembly formed by the mold, it is necessary to also adjust the mass of the counter weight body to balance the assembly for use on the fan apparatus. However, because the counterweight body presents a receptacle within which additional weight can be placed, it is not necessary to employ a second mold insert as with the previously described embodiments. Instead, the mass of the body is designed to be less than or equal to that required to balance the assembly when the first mold insert is used, and an additional weight of suitable mass is molded into the body during the molding process to balance the assembly. In order to accommodate varying blade sizes of the assembly, weights 160 of different masses can be employed, each being sized for encapsulation within the receptacle 158.

A variation of the assembly is shown in FIG. 27, and includes a hub 144 and a blade 146 identical to that of the assembly shown in FIGS. 25 and 26. The assembly shown in FIG. 27 differs in that the counter weight body 162 includes a solid molded stud or shaft presenting a proximal end that is integral with the hub, and a remote distal end. The outer surface of the stud is threaded along the distal end of the body, and defines a support surface sized for receipt of a spherical weight 164 that includes a diametrical hole by which it is received on the stud. The weight is retained on the stud by a threaded nut 166. As such, the weight of the counter weight body can be supplemented to balance the assembly for rotation on the drive shaft of the fan apparatus.

The method of manufacturing the blade assembly shown in FIG. 27, includes molding the assembly as a unitary part using a synthetic resin material such as high density polyethylene or polypropylene. The mold is preferably adapted for use in an injection or rotation molding machine, or any other type of machine capable of use in forming such materials.

The mold includes a hub cavity, a blade cavity protruding from the hub cavity in a first direction, and a counterweight-body cavity protruding radially from the hub in a second direction opposite the first direction. The cavities are in communication with one another so that the blade assembly can be formed of a unitary molded piece of synthetic resin material. A removable first mold insert is provided, and is sized for receipt in the blade cavity to reduce the size of the blade cavity. Preferably, the first mold insert fills a portion of the blade cavity remote from the hub cavity such that when a blade assembly is molded with the insert in place, the length of the molded blade is smaller than that of a blade molded with the insert removed from the blade cavity.

Because the counterweight body presents a stud on which additional weight can be placed, it is not necessary to employ a second mold insert as with the previously described embodiments. Instead, the mass of the body is designed to be less than or equal to that required to balance the assembly when the first mold insert is used, and the appropriate sized weight 164 is added to the body to balance the assembly.

Although the blade assemblies illustrated in FIGS. 25–27, include a unitary construction in which the hub, blade and counter weight body are formed in a single mold, it is possible to substitute the construction of FIG. 28, where a metal blade 168 is desired. In the assembly of FIG. 28, the hub 170 and counter weight body 172 are substantially similar to the hub and counter weight body of the assembly shown in FIG. 27. However, the hub 170 is molded with a blade support 174 that protrudes from the hub in the first direction opposite the counter weight body 172. The blade support 174 includes a plurality of apertures sized for receipt of fasteners, and permits a blade of any desired shape or size to be fastened to the hub.

The method of manufacturing the blade assembly shown in FIG. 28, includes molding the hub and counter weight assembly as a unitary part using die cast aluminum or zinc, or a synthetic resin material such as high density polyethylene or polypropylene. The mold is preferably adapted for use in an injection or rotation molding machine, or any other type of machine capable of use in forming such materials.

Because the blade is formed separately, it is not necessary to employ mold inserts in forming the hub and counter weight body. Likewise, because the counterweight body presents a stud on which additional weight can be placed, it is not necessary to employ a second mold insert. Instead, the appropriate sized weight is added to the body to balance any particular blade fastened to the hub.

Another embodiment of the invention is shown in FIGS. 29 and 30, and includes a die formed sheet metal blade 176 and counter weight body 178 that are formed as a unitary part, and a hub 180 that is affixed to the blade by a plurality of threaded fasteners or the like.

The hub 180 of the assembly is tubular, presenting a central longitudinal axis and an inner diameter that permits the hub to be received on the drive shaft of the fan apparatus. A threaded transverse hole is tapped or otherwise formed in the hub so that a set screw or the like can be used to fasten the blade assembly on the drive shaft of the apparatus for rotation therewith.

The blade 176 protrudes radially from the hub in a first direction, and includes a proximal end that is generally planar, presenting a mounting surface to which the hub is fastened, and a distal end remote therefrom. The blade also presents leading and trailing edges that are separated from one another by the width of the blade. Preferably, the thickness of the blade is constant between the leading and trailing edges. However, other blade plan forms and/or profiles can be employed without departing from the present invention.

The counterweight body 178 protrudes from the mounting surface of the blade in a second direction opposite the first direction, and includes a generally planar shape defining a pair of opposed support surfaces sized for receipt of one or more weights 182 that are retained on the surface by threaded fasteners or by an adhesive. As such, the weight of the counter weight body can be supplemented to balance the assembly for rotation on the drive shaft of the fan apparatus. As shown in FIG. 30, the body 178 is pitched relative to the mounting surface of the blade 176 by an angle equal but opposite to the pitch of the blade so that it resembles a short blade capable of generating at least some air movement during rotation of the assembly on the fan apparatus.

Although the invention has been described with reference to the preferred embodiment illustrated in the attached drawing figures, it is noted that equivalents may be employed and substitutions made herein without departing from the scope of the invention as recited in the claims. For example, although the several embodiments of the invention differ from one another, and each provides advantages and disadvantages relative to the others, the various features of the various embodiments may be combined in a manner other than that disclosed in the specification and drawing in order to produce a blade assembly in accordance with the present invention.

What is claimed is:

1. A method of constructing a blade assembly for a fan apparatus, wherein the blade assembly includes a hub, a single blade, and a counterweight, the method comprising the steps of:

providing a mold including a hub cavity, a blade cavity protruding from the hub cavity in a first direction, and a counterweight-body cavity protruding radially from the hub in a second direction opposite the first direction, the cavities being in communication with one another so that the blade assembly can be formed of a unitary molded piece of synthetic resin material;

fitting a removable first mold insert in the blade cavity, the first mold insert filling a portion of the blade cavity remote from the hub cavity; and injecting a synthetic resin material into the mold with the first mold insert in place to form a blade assembly having a blade with a dimension in the first direction that is shorter than the dimension of the blade in the first direction would be if the synthetic resin material was injected into the mold with the first mold insert removed.

2. The method as recited in claim 1, further comprising the step of fitting a removable second mold insert in the counterweight-body cavity, the second mold insert filling a portion of the counterweight-body cavity so that when synthetic resin material is injected into the mold, the blade assembly formed thereby includes a counterweight body having a mass that is smaller than the mass would be if the second mold insert were removed from the counterweight-body cavity.

3. The method as recited in claim 1, further comprising the step of adding weight to the counterweight body of the blade assembly.

4. The method as recited in claim 3, wherein the counterweight body is hollow, and the step of adding weight to the counterweight body includes inserting weight into the body.

5. The method as recited in claim 3, wherein the counterweight body is flat, and the step of adding weight to the counterweight body includes securing at least one weight to the body.

6. The method as recited in claim 3, wherein the counterweight body presents a cylindrical support surface, and the step of adding weight to the counterweight body includes sliding at least one weight onto the support surface, the weight presenting an aperture sized for receipt of the counterweight body.

7. The method as recited in claim 3, wherein the step of adding weight to the counterweight body includes adhering weight to the counterweight body with an adhesive material that is placed between the weight and the counterweight body.

8. The method as recited in claim 3, wherein the step of adding weight to the counterweight body includes securing at least one weight within the counterweight body.

9. A blade assembly for a fan apparatus, the blade assembly comprising:

a hub presenting a longitudinal aperture adapted for receipt of the fan apparatus;

a blade protruding radially from the hub in a first direction;

a counterweight body protruding radially from the hub in a second direction opposite the first direction, the hub, blade and counterweight body being formed of a unitary piece of synthetic resin material; and at least one weight supported on the counterweight body.

10. The blade assembly of claim 9, wherein the blade assembly is in combination with said fan apparatus, said fan apparatus for circulating air.

11. A blade assembly for a fan apparatus, the blade assembly comprising:

a hub presenting a longitudinal aperture adapted for receipt on the fan apparatus;

blade protruding radially from the hub in a first direction;

a counterweight body protruding radially from the hub in a second direction opposite the first direction, the hub, blade and counterweight body being formed of a unitary piece of synthetic resin material, wherein the counterweight body is hollow;

at least one weight supported in the hollow counterweight body; and a cap for enclosing the weight in the counterweight body.

12. The blade assembly of claim 11, wherein the blade assembly is in combination with said fan apparatus, said fan apparatus for circulating air.

13. A blade assembly for a fan apparatus, the blade assembly comprising:

a hub presenting a longitudinal aperture adapted for receipt on the fan apparatus;

a blade protruding radially from the hub in a first direction;

a counterweight body protruding radially from the hub in a second direction opposite the first direction, the hub, blade and counterweight body being formed of a unitary piece of synthetic resin material, wherein the counterweight body is hollow;

at least one weight supported in the hollow counterweight body, wherein the at least one weight is adhered to the counterweight body by an adhesive material.

14. The blade assembly of claim 13, wherein the blade assembly is in combination with said fan apparatus, said fan apparatus for circulating air.

15. A blade assembly for a fan apparatus, the blade assembly comprising:

a hub presenting a longitudinal aperture adapted for receipt on the fan apparatus;

a blade protruding radially from the hub in a first direction;

counterweight body protruding radially from the hub in a second direction opposite the first direction, the hub, blade and counterweight body being formed of a unitary piece of synthetic resin material, wherein the counterweight body presents a cylindrical support surface; and at least one weight presenting an aperture sized for receipt on the cylindrical support surface of the counterweight body.

16. The blade assembly of claim 15, wherein the blade assembly is in combination with said fan apparatus, said fan apparatus for circulating air.

17. The blade assembly as recited in claim 9, wherein the fan apparatus presents a drive shaft on which the blade assembly is adapted for receipt, and includes a set screw for securing the blade assembly on the drive shaft, the hub of the blade assembly including a cylindrical tube that is adapted for receipt on the drive shaft of the fan apparatus, the tube presenting a transverse hole adapted for receipt of the set screw.

18. The blade assembly as recited in claim 9, wherein the at least one weight is adhered to the counterweight body by an adhesive material.

19. The blade assembly as recited in claim 15, wherein the counterweight body is tubular, presenting a central aperture.

20. The blade assembly as recited in claim 15, wherein the counterweight body is cylindrical.

21. The blade as assembly as recited in claim 20, wherein the support surface of the counterweight body includes a plurality of circumferentially extending grooves separated from one another by ridges, and the at least one weight is retained by the ridges in the grooves of the support surface.

22. A blade assembly for a fan apparatus, the blade assembly comprising:

a hub presenting a longitudinal aperture adapted for receipt on the fan apparatus;

a blade protruding radially from the hub in a first direction;

a counterweight body protruding radially from the hub in a second direction opposite the first direction, the hub, blade and counterweight body being formed of a unitary piece of synthetic resin, wherein the counterweight body is a hollow channel with at least one open end; and at least one weight removably supported in the hollow counterweight body, said weight being removable from the body without destruction of the weight and the body.

23. The blade assembly of claim 22, wherein the blade assembly is in combination with said fan apparatus, said fan apparatus for circulating air.

24. A blade assembly for a fan apparatus, the blade assembly comprising:

a hub presenting a longitudinal aperture adapted for receipt on the fan apparatus;

a blade protruding radially from the hub in a first direction;

a counterweight body protruding radially from the hub in a second direction opposite the first direction, wherein the counterweight body is a hollow channel with at least one open end; and at least one weight supported in the hollow counterweight body, wherein the weight is removable, said weight being removable from the body without destruction of the weight and the body.

25. The blade assembly of claim 24, wherein the blade assembly is in combination with said fan apparatus, said fan apparatus for circulating air.

26. A blade assembly for a fan apparatus, the blade assembly comprising:

a hub presenting a longitudinal aperture adapted for receipt on the fan apparatus;

a blade protruding radially from the hub in a first direction; and a counterweight body protruding radially from the hub in a second direction opposite the first direction, wherein the hub and counterweight body form a unitary body and wherein the blade is formed separately from said unitary body.

27. The blade assembly of claim 26, further comprising an aperture formed in the hub, wherein the aperture is adapted to receive a set screw for fastening the blade to the hub.

28. The blade assembly of claim 26, wherein the blade assembly is in combination with said fan apparatus, said fan apparatus for circulating air.

29. A mold apparatus for molding a fan assembly, the mold apparatus comprising:

a hub cavity;

blade cavity protruding radially from the hub cavity in a first direction; and a counterweight body cavity protruding radially from the hub in a second direction opposite the first direction, wherein each of the hub cavity, the blade cavity and the counterweight body cavity are in fluid communication with one another for forming a unitary molded piece of synthetic resin material.

30. The mold apparatus of claim 29, further comprising one or more removable first mold inserts, wherein each first mold insert is sized for receipt in the blade cavity to adjust the size of the blade cavity.

31. The mold apparatus of claim 30, further comprising one or more removable second mold inserts, wherein each second mold insert is sized for receipt in the counterweight body cavity to adjust the size of the counterweight body cavity.

32. A blade assembly for a fan apparatus, the blade assembly comprising:

a hub presenting a longitudinal aperture adapted for receipt on the fan apparatus;

a blade protruding radially from the hub in a first direction;

a counterweight body protruding radially from the hub in a second direction opposite the first direction, the hub, blade and counterweight body being formed of a unitary piece of synthetic resin, wherein the counterweight body is a hollow channel with at least one open end; and at least one rigid weight supported in the hollow counterweight body, further comprising a cap adapted for receipt within at least one open end of the hollow channel for closing the open end of the hollow channel.

33. A blade assembly for a fan apparatus, the blade assembly comprising:

a hub presenting a shaft-receiving opening and a hole that is at least substantially transverse to the opening and is adapted for receiving a set screw;

the set screw received in the hole in the hub for securing the blade assembly to the fan apparatus;

a blade protruding radially from the hub in a first direction;

a counterweight body protruding radially from the hub in a second direction opposite the first direction; and at least one weight removably supported by the counterweight body, said weight being removable from the body without destruction of the weight and the body.

34. The blade assembly as claimed in claim 33, wherein the hub, blade and counterweight body are formed of a unitary piece of material.

35. The blade assembly as claimed in claim 34, wherein the unitary piece of material is a synthetic resin.

36. The blade assembly as claimed in claim 33, wherein the at least one weight is supported in the counterweight body.

37. A blade assembly for a fan apparatus, the blade assembly comprising:

a hub presenting a shaft-receiving opening and a hole that is at least substantially transverse to the opening and is adapted for receiving a set screw;

a set screw received in the hole in the hub for securing the blade assembly to the fan apparatus;

a blade protruding radially from the hub in a first direction; and a counterweight body protruding radially from the hub in a second direction opposite the first direction;

at least one weight supported by the counterweight body, wherein the at least one weight is supported on the counterweight body.

38. A blade assembly for a fan apparatus, the blade assembly comprising:

a hub presenting a shaft-receiving opening and a hole that is at least substantially transverse to the opening and is adapted for receiving a set screw;

a set screw received in the hole in the hub for securing the blade assembly to the fan apparatus;

a blade protruding radially from the hub in a first direction; and a counterweight body protruding radially from the hub in a second direction opposite the first direction;

at least one weight supported by the counterweight body, wherein said at least one weight is removably supported by the counterweight body.

* * * * *